US006048129A

United States Patent [19]

Rue

[11] Patent Number: 6,048,129

[45] Date of Patent: Apr. 11, 2000

[54] PAVEMENT MAT FORMED FROM DISCARDED TIRES AND METHOD FOR MAKING SAME

[76] Inventor: Herman Rue, 167 N. - 269 Durio Rd., Plaisance, La. 70582

[21] Appl. No.: 09/113,524

[22] Filed: Jul. 10, 1998

[51] Int. Cl.[7] ..... E01C 5/18

[52] U.S. Cl. ..... 404/32; 404/36; 404/45; 404/71; 404/73

[58] Field of Search ..... 14/2.4; 404/32, 404/36, 45, 71, 73, 6; 256/1

[56] References Cited

U.S. PATENT DOCUMENTS

| | | | |
|---|---|---|---|
| 3,764,446 | 10/1973 | Martin | 404/6 |
| 3,848,853 | 11/1974 | Way et al. | 256/1 |
| 4,022,434 | 5/1977 | Moore | 256/1 |
| 4,142,821 | 3/1979 | Doring | 405/258 |
| 4,785,577 | 11/1988 | Lederbauer | 47/33 |
| 4,801,217 | 1/1989 | Goldberg . | |
| 4,850,738 | 7/1989 | Niemi | 404/31 |
| 5,131,787 | 7/1992 | Goldberg . | |
| 5,250,340 | 10/1993 | Bohnhoff | 428/99 |
| 5,568,913 | 10/1996 | Nagler | 256/13.1 |

FOREIGN PATENT DOCUMENTS

| | | |
|---|---|---|
| 3119208 | 5/1991 | Japan . |
| 1330228 | 8/1987 | U.S.S.R. . |

*Primary Examiner*—Eileen Dunn Lillis
*Assistant Examiner*—Gary S. Hartmann
*Attorney, Agent, or Firm*—William W. Stagg

[57] ABSTRACT

A pavement mat to be used in the construction of temporary roadways comprising a plurality of vehicle tire segments tightly compressed and bound between preceding and succeeding stabilizer members. Each of the stabilizer members has an end plate and a plurality of tie rods that extend perpendicularly outward from its surface. The end plates also have rod holes to receive the tie rods the next succeeding stabilizer member. The preceding and succeeding stabilizer members are held in place by bolts or other means. When the vehicle tires are compressed together between the stabilizer members they are penetrated by the tie rods of its preceding stabilizer member. These tie rods stitch the tires together and keeps the tires tightly compressed together between the stabilizer members. A cap plate stabilizer member, without tie rods, is for use as the last of the succeeding stabilizer members, the cap plate has holes for receiving each of the tie rods of its immediately preceding stabilizer member. A frame and rams are used to compress the tires and the stabilizer members together.

10 Claims, 8 Drawing Sheets

PAVEMENT MAT FORMED FROM DISCARDED TIRES AND METHOD FOR MAKING SAME

FIELD OF INVENTION:

The present invention generally relates to the field of temporary pavement mats used in the oil and gas and construction industries, and, more particularly, it relates to a pavement mat formed from discarded automobile tires. The mat is formed by placing discarded tires into a mat sized metal frame and compressing the tires between stabilizer members and onto metal tie rods to bind and tie the compressed tires together.

BACKGROUND OF THE INVENTION

In the construction, oil and gas, and logging industries, as well as many others, access by heavy vehicles over natural ground to the remote or undeveloped areas where the work is often performed is frequently limited or impossible. The soils in such areas are typically muddy, swampy, soft and otherwise unstable. Temporary roads are usually required to provide vehicle access to construction areas where such unstable ground services exist. These temporary roads are usually made from mats that are linked together and these mats serve to distribute the weight of vehicle travel over soft ground area to facilitate the movement of vehicles to, from and around the construction areas.

In the past, such construction mats have been formed from wooden timbers or boards. Timber mats are expensive and place additional demand upon timber resources. For environmental purposes, the use of discarded rubber tires as a mat construction material has been suggested. One such suggestion is U.S. Pat. No. 5,131,787 to Jerry Goldburg which disclosed a mat constructed from an array of overlapping truck tire sidewalls supported from beneath by a flooring made from truck tire tread portions. However, this method of mat construction requires that the various components of the discarded tires be separated from the whole tire, i.e. the sidewall portion and the tread portion, so that they can be utilized separately in constructing the mat. This increases the expense of mat construction.

Another method of using discarded tires in mat construction is that shown in Japanese patent 3-119,208 which describes a mat formed from a lattice work of wasted tire tread pieces. This method also requires that the discarded tires be cut into pieces so that they may be woven together to form the mat. The cutting and weaving is time consuming and expensive.

Another method is that shown in SU 1330-228-A which discloses forming a road surface from slabs of tires joined to each other by cables positioned along the axis of the roads. Each tire slab is composed of arched sections of used car tires that are arranged radially in close contact with one another. The tire sections have cutouts through which the cables pass. This method also requires the tire tread sections to be cut away from the sidewall sections and further requires the arched tire sections to be arranged radially which increase the labor in construction.

Still another used tire mat is that show in U.S. Pat. No. 4,801,217 to Jerry Goldburg. In Goldburg, tire beads from used tires were tied together in an array to produce a mat for construction and for use as an underlayment for roadways. Super imposing one of such mats upon the other to form a mat achieved the underlayment. Again, this method requires the discarded tires to be cut into component pieces before they are linked together to form the mat. The cutting and linking is time consuming and expensive.

The heretofore proposed methods of forming construction mats from discarded tires required the components parts of the individual tires to be separated from the tire, that is, the separation of the tire tread section from the tire sidewall section. These methods also required the individual tire segments so separated to be fixed or arrayed in a uniform or consistent manner before being linked together to form a mat. These steps in the prior methods are expensive and time consuming. Consequently, a need exists for improved pavement mat as well as for improved methods in making the mat that will allow the formation of pavement mats from discarded tires in less expensive and time consuming manner and that allows for the use of discarded tires as a mat component without requiring the separation of the component parts of the tire during the mat assembly process.

SUMMARY OF THE INVENTION

The present invention provides a pavement mat made from discarded tires and a method for making the same that is designed to satisfy the aforementioned needs.

Applicant's pavement mat and method does not require the component parts of the individual tires used to construct the mat to be separated from each other. Nor does the pavement mat and method require the component parts of the discarded tires to be configured in any particular way to form the mat. Rather, the pavement mat of applicant's invention is formed by compressing the discarded tires tightly together within a frame and then binding the compressed tires together by means of stabilizer members and tie rods.

The frame holds the tightly compressed tires in place and the discarded tires need only be cut in half in order to facilitate their compression onto the tie rods. After tires are cut in half, they may be introduced randomly into the frame and compressed in place. This reduces the time and expense associated with cutting the used tires into their component parts and in fashioning mats from these component parts in a particular pattern.

Applicant's pavement mat and method further allows the use of all of the discarded tire in the formation of the mat. The use of all of the discarded tire in the mat eliminates the need for finding alternate means for the use or the disposal of the unused tire segments. This results in reduced mat costs and lessens the environmental impact associated with tire disposal.

Pavement mats made in accordance with applicant's invention may be utilized in the construction of temporary roads or work areas to provide access to heavy vehicle traffic. The pavement mats may also be used as semi-permanent pavement material for parking lots or other areas of vehicle traffic or for temporary pedestrian walkways.

In the preferred embodiment, the pavement mat of applicant's invention is a rectangular mat comprised of a plurality of discarded tire segments tightly compressed together between a plurality of succeeding stabilizer members that extend transversely across the width of the mat. The tires after being tightly compressed are held in place between these stabilizer members by a plurality of metal tie rods that run between the stabilizer members along the longitudinal axis of the mats. These metal tie rods penetrate the tire segments and serve to stitch the tire segments tightly together to form the mat.

To form a pavement mat according to applicant's invention, a stabilizer member having a plurality of pointed threaded metal tie rods extending outwardly from the stabilizer member is placed against the rear portion of a rectangular mat frame. Then a plurality of discarded tires, each cut in half, are placed into the frame. The tire sidewalls and tire treads are not separated from each other. The half tires are then compressed tightly together against the stabilizer member and onto the tie rods by the use of a hydraulic ram to form a first mat segment.

After the first mat segment is formed, a second stabilizer member is placed into the frame and pushed over the tie rods of the first stabilizer against the tire halves. The first and second stabilizer members are then secured together by bolts or other means to hold the compressed tires together between the stabilizer members. Subsequent tires and stabilizer members are then added to build a mat of a desired length.

It is an object of the invention to provide a pavement mat for use as a temporary road, the mat being comprised of discarded vehicle fires, the vehicle tires being tightly compressed together to form the mat.

It is a further object of the invention to provide a pavement mat for use in the construction and temporary road industries, the pavement mat being comprised of discarded vehicle tires, the discarded vehicle tires being tightly compressed together within a frame.

It is still another object of the invention to provide a method of forming a pavement mat for use as a temporary road or parking area formed from discarded tires, the tires being tightly compressed together between stabilizing members.

Other objects of the invention will be readily apparent from the description set forth herein.

DESCRIPTION OF THE PREFERRED EMBODIMENT

Figure 1:
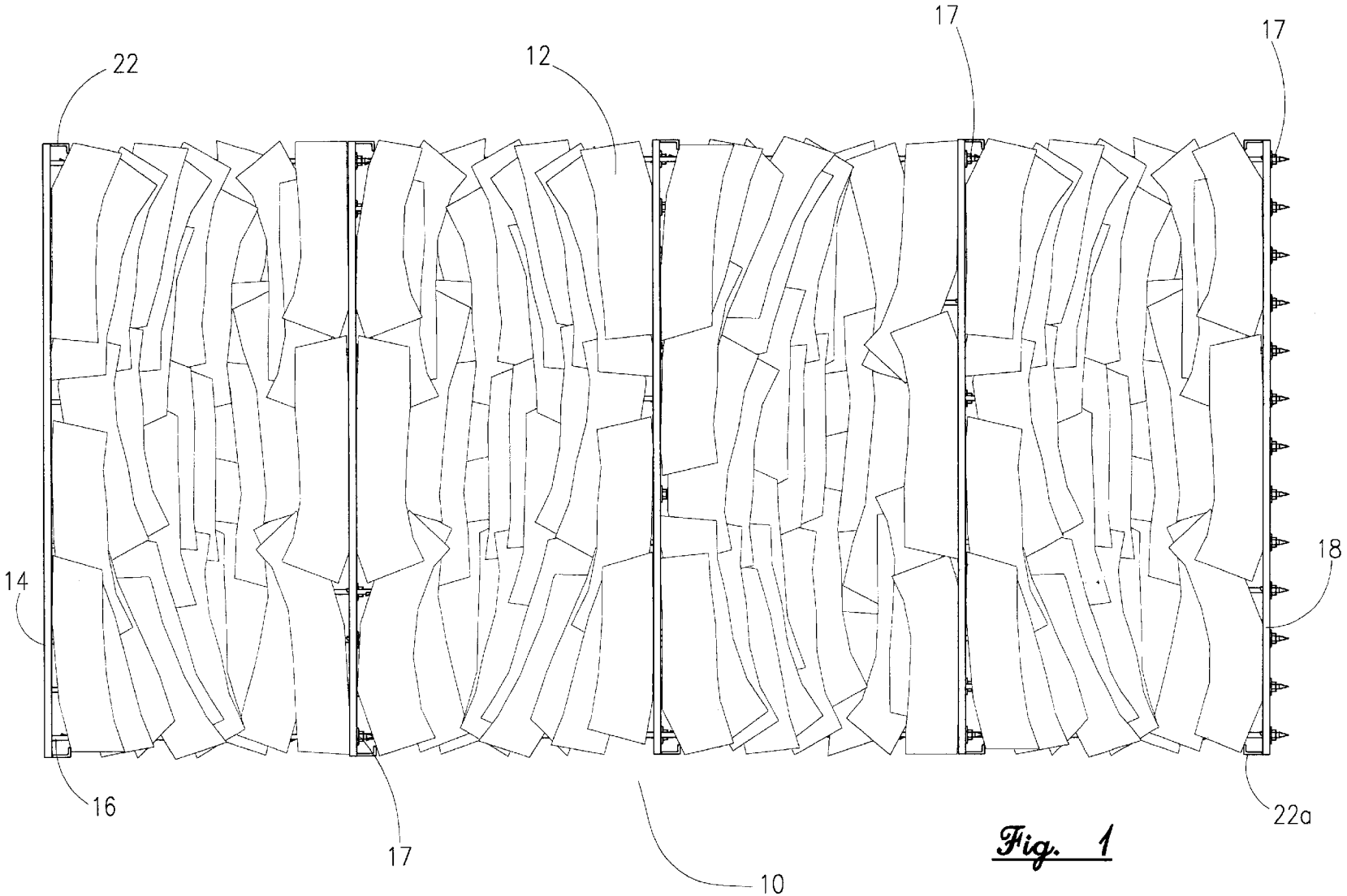
FIG. 1 is a plan view of a pavement mat constructed in accordance with applicant's invention.

Referring now to the drawings and more particularly to FIG. 1, there is shown a plan view of the preferred embodiment of a pavement mat 10 constructed in accordance with the present invention. The mat 10 is formed from a plurality of discarded vehicle tires 12. The tires 12 are tightly compressed between succeeding stabilizer members 14. Each stabilizer member 14 has a plurality of pointed tie rods 16 that are orientated along the longitudinal axis of the mat 10.

Figure 2:
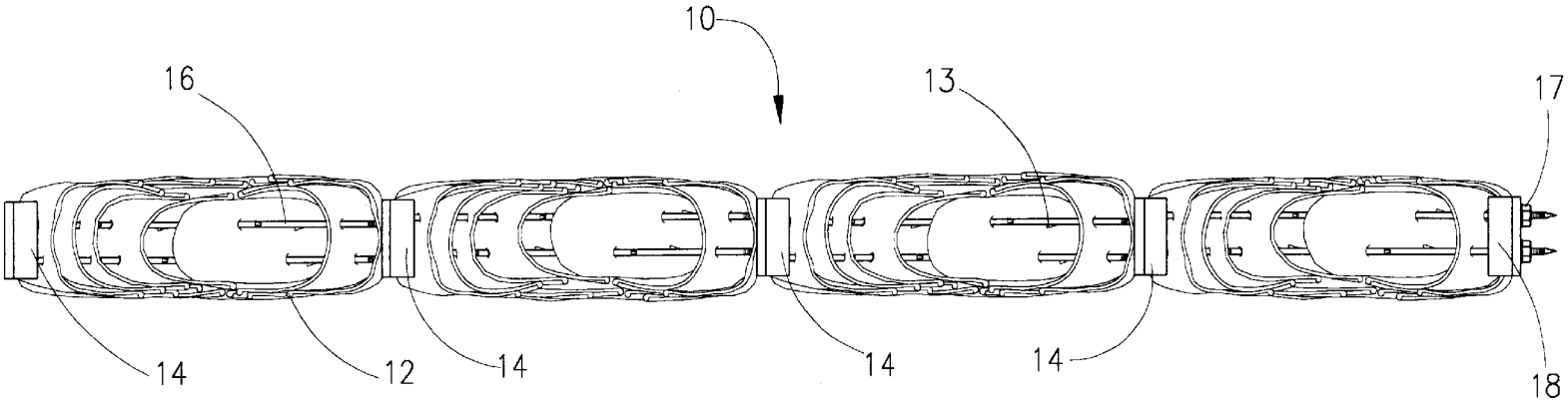
FIG. 2 is a longitudinal side view of the mat of FIG. 1.
Figure 3:
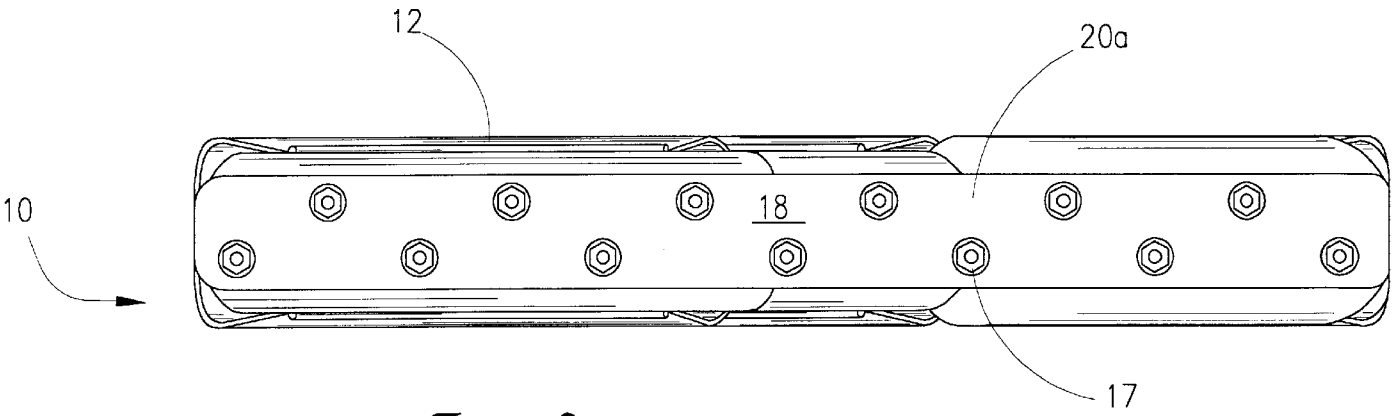
FIG. 3 is an end view of the mat of FIG. 1.

As can be seen from FIG. 2, the tie rods 16 of each stabilizer member 14 penetrate the tires 12 as the tires 12 are compressed between the stabilizer members 14. The succeeding stabilizer members 14 are connected together to bind the compressed tires 12 together by means of nuts 17 threaded onto the ends of the tie rods 16. A stabilizer cap piece 18, as shown in FIG. 3, is used to terminate the end of the mat 10 at the desired length.

Figure 5:
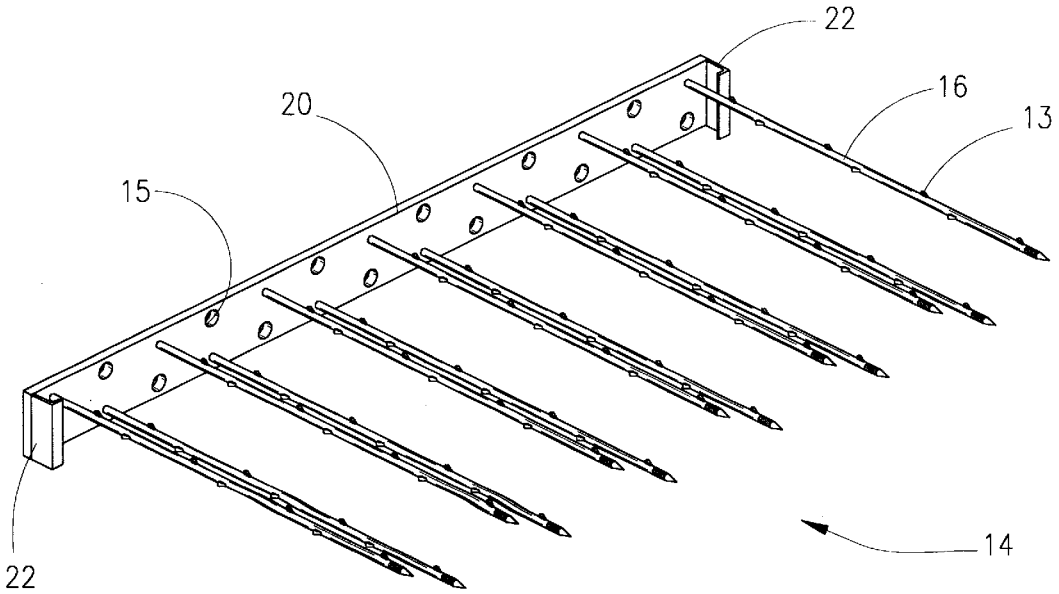
FIG. 5 is a perspective view of a stabilizer and tie rod member.

FIG. 5 show a perspective view of the stabilizer member 14. Each stabilizer member 14 is comprised of a plate 20 of a desired thickness, length and width, each end of the plate 20 having end return pieces 22. A plurality of tie rods 16, staggered in two rows, are perpendicularly attached to the plate 20. A plurality of holes 15, also staggered in two rows, are located opposite each tie rod 16. Each tie rod 16 has a plurality of protruding teeth 13 to assist in holding a penetrated tire 12 onto the tie rod 16. The ends of each tie rod 16 are threaded to accommodate a nut or other attaching means.

Figure 4:
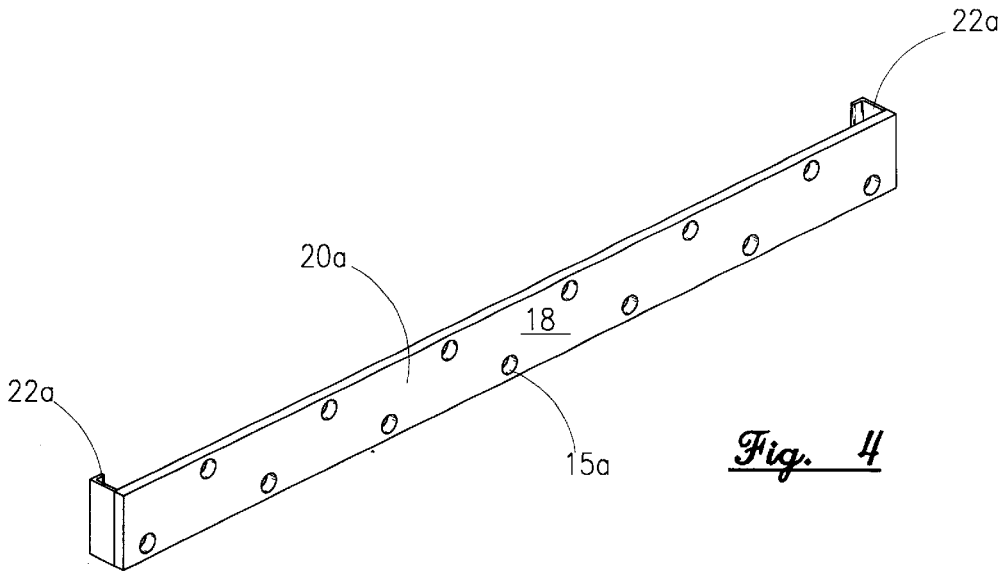
FIG. 4 is a perspective view of a stabilizer cap piece.

Similarly, FIG. 4 shows a perspective view of the stabilizer cap piece 18. Each stabilizer cap piece 18 is comprised of a plate 20*a* of a desired thickness, length and width, each end of the plate 20*a* having end return pieces 22*a*. Each cap piece 18 has a plurality of holes 15*a*, also staggered in two rows, and positioned on the cap piece 18 to correspond to the position of the tie rods 16 located on the stabilizer piece 14.

In the preferred embodiment a typical width of plates 20 and 20*a* would be equal to the average tread width of the tires being compressed, approximately eight to ten inches, and a typical length of plates 20 and 20*a* would be equal to eight feet, equal to a roadway lane width. However, it should be noted that the length and a width of the plates 20 and 20*a* may vary as desired without departing from the scope of the invention.

Figure 6:
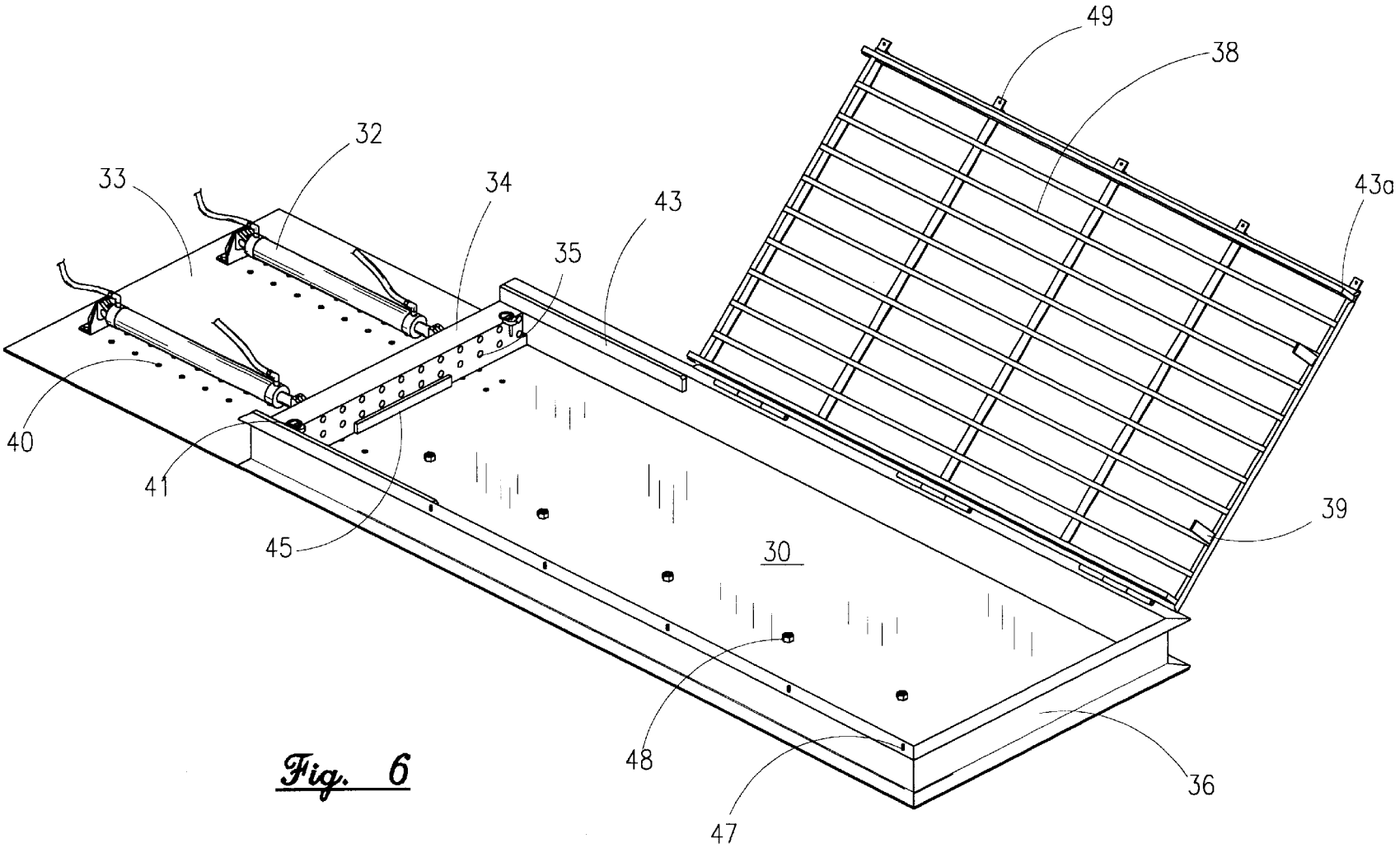
FIG. 6 is a perspective view of the mat frame.

The pavement mat 10 is formed in a compression frame assembly 30 shown in a perspective view in FIG. 6. The frame assembly 30 is comprised of rectangular shaped frame 36 open at one end and mounted over a flat base surface 33. The base surface 33 may be comprised of a metal plate or a concrete pad. The frame 36 may be made of channel shaped structural members as illustrated or from other structural members such as tubular shapes as desired. The open end of the frame 36 is fitted with a ram head 34 mounted to a pair of rams 32. Each ram 32 is fixed to the flat surface of the frame assembly by means of a plurality ram mounting holes 40 on the surface 33. In the preferred embodiment the rams 32 are hydraulic rams though other rams, such as pneumatic rams could be utilized.

The ram head 34 has a plurality of holes 35 positioned to correspond with the tie rods 16 on the stabilizer members 14. The position of each ram 32 in relationship to the open end of the frame 36, and therefore the position of the ram head 34, may be adjusted by the choice of ram mounting holes 40 used to fix the rams 32 in place. As shown in FIG. 6 and in section in FIG. 10, the ram head 34 may be fitted with a lift plate 45 to maintain the stabilizer members 14 and 18 at a desired position with respect to the frame base 33. Guide plates 43 along the inside of the frame 36 keep the ram head 34 in position with relationship to the frame 36.

The frame assembly 30 has a cover cage 38 pivotally mounted on the frame 36. The cover cage 38 is used to retain the tires 12 as they are compressed within the frame assembly 30 during mat construction. The cover cage 38 has retainers 39 extending perpendicularly from the cover cage 38 into the area enclosed by the frame 36 to retain the first stabilizer member 14 during frame assembly. In addition, a guide plate 43*a* is attached to the cover cage 38 to assist in guiding the ram head 34 when the cover cage 38 is closed. The cover cage 38 is held in place on the frame 36 by means of mounting tabs 49 and studs 47.

Figures 7, 13:
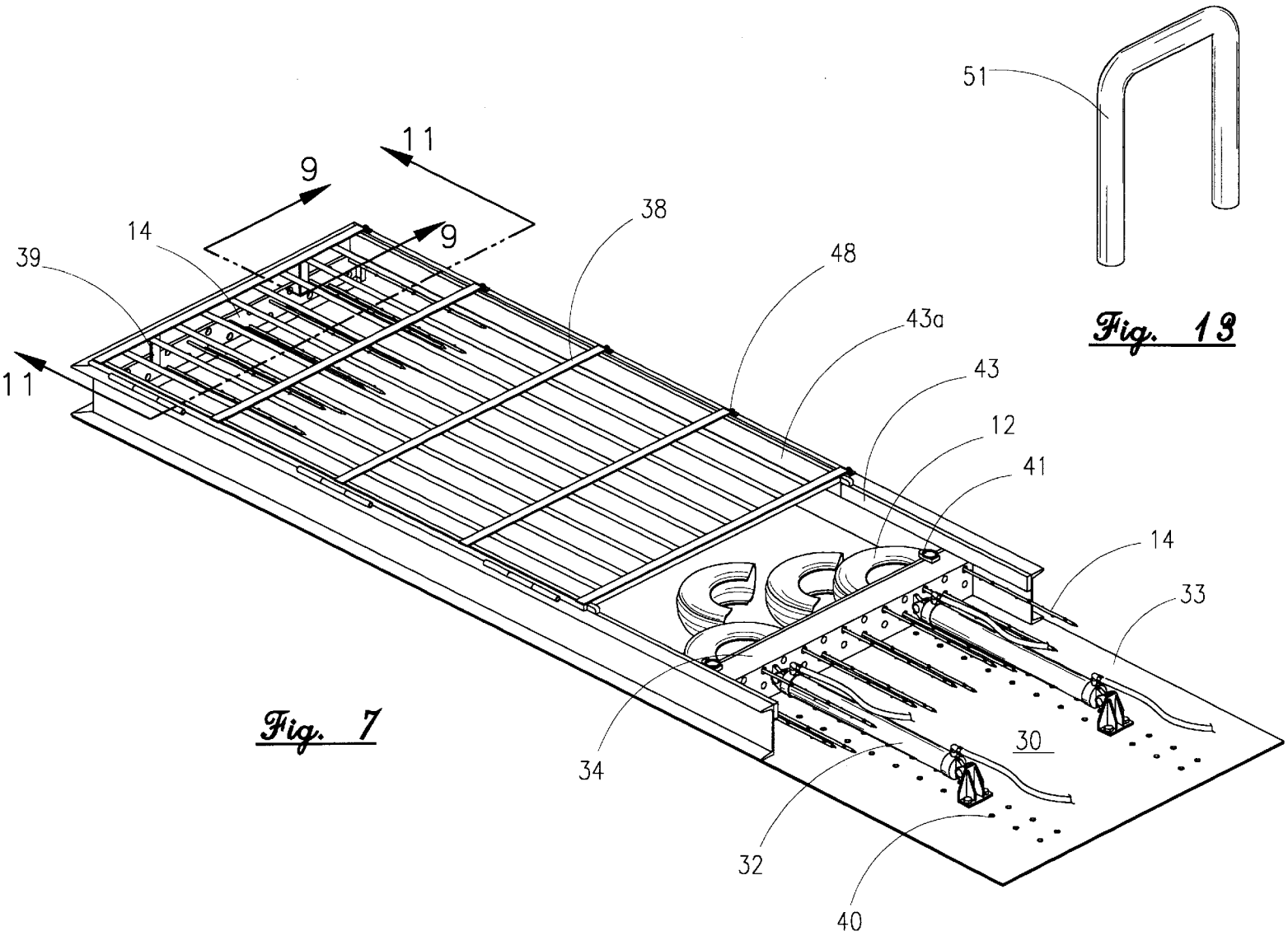
FIG. 7 is a perspective view of the mat frame of FIG. 6 showing the mat forming method.
FIG. 13 is a perspective view of the linking pin used in connecting a plurality of pavement mats together.
Figure 8:
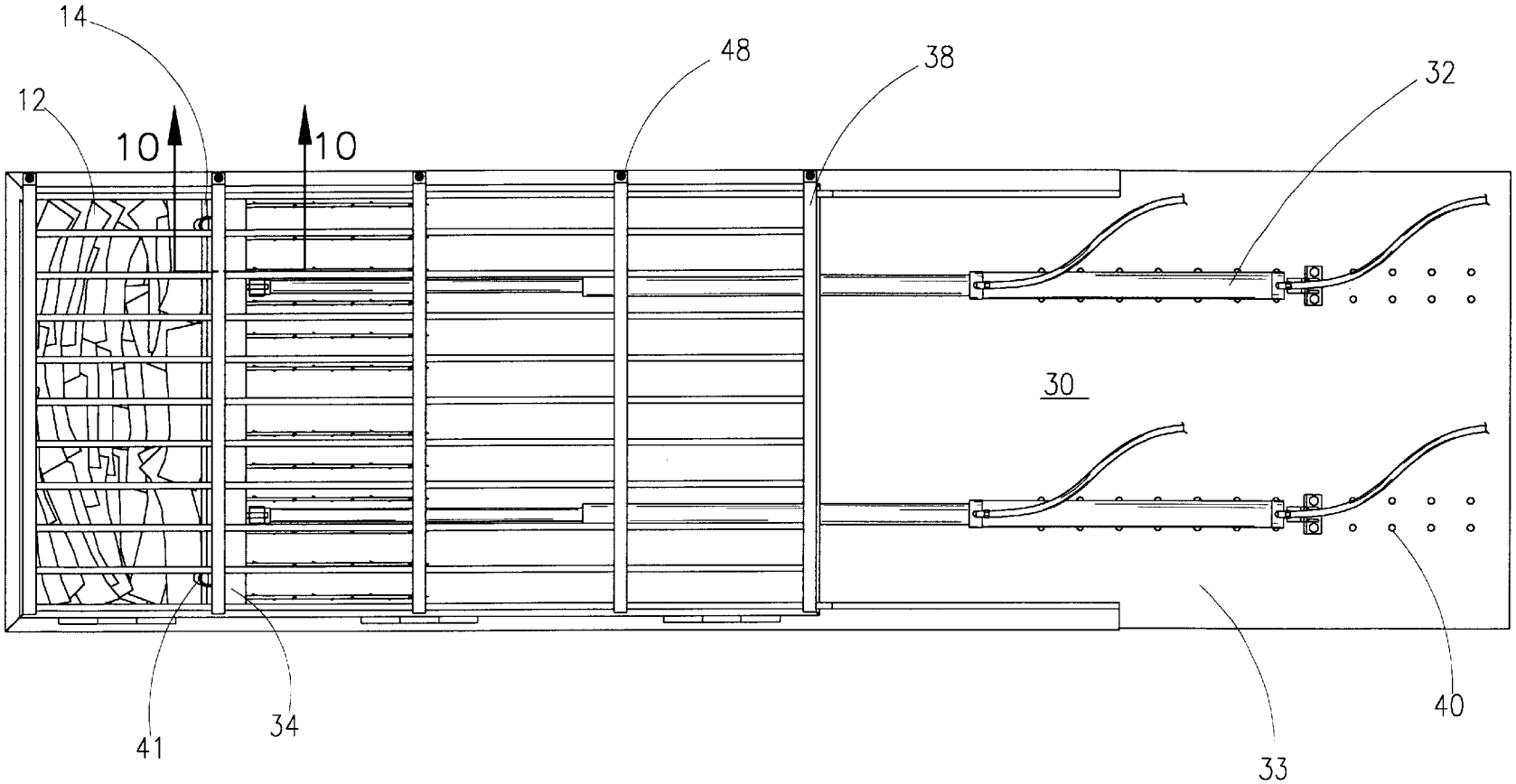
FIG. 8 is a plan view of the mat frame and mat forming method.
Figure 9:
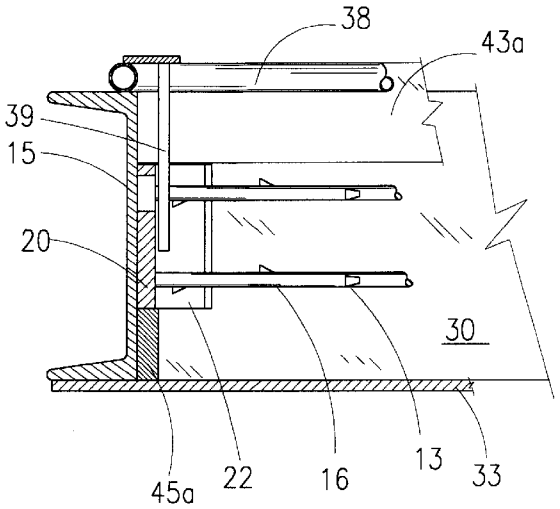
FIG. 9 is longitudinal cross-sectional view of the stabilizer and tie rod member from FIG. 7.
Figure 11:
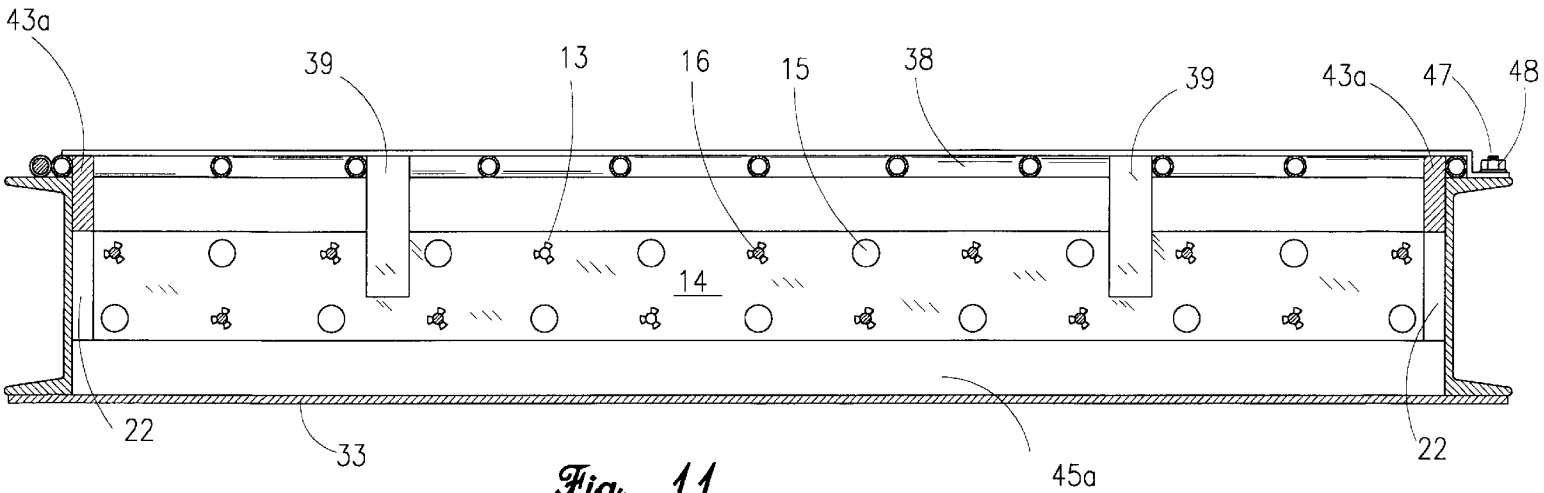
FIG. 11 is a transverse cross-sectional view of the mat from FIG. 7.

FIG. 7 and FIG. 8 illustrate the construction of a pavement mat 10 in accordance with the present invention. The initial step is to place a first stabilizer member 14 within the frame 36 of the frame assembly 30 with the tie rods 16 of the stabilizer member 14 extending toward the center of the frame 36. The first stabilizer member 14 in position on the frame assembly 30 is shown in section in FIG. 9 and in elevation in FIG. 11. The member 14 rests on support 45*a* and is held in position by retainers 39.

A second stabilizer member 14 is place onto the ram head 34 with its tie rods 16 extending through the holes 35 of the ram head 34 in the same direction as the tie rods of the first stabilizer member 14. This holds the plate 20 of the stabilizer member 14 in a position perpendicular to the surface 33 of the plate assembly 30.

Figure 10:
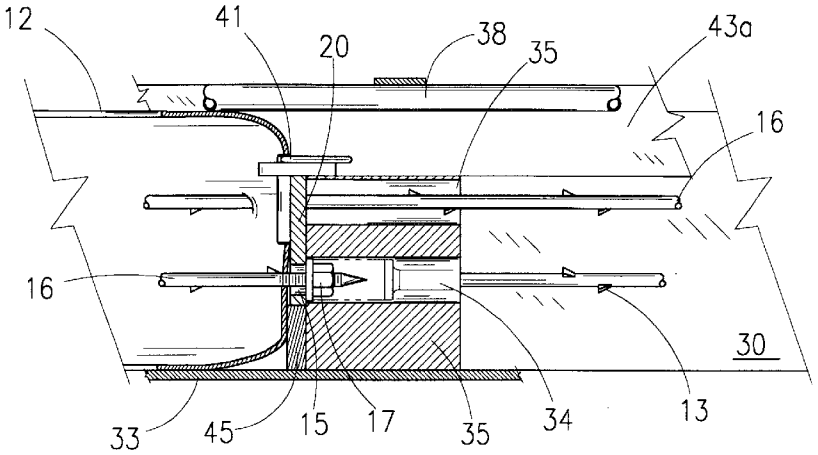
FIG. 10 is longitudinal cross-sectional view of the mat from FIG. 8.

After the first and second stabilizer members are in place, a plurality of discarded tires 12, cut into halves across the diameter of the tire, are then placed on the frame base 33. The cover cage 38 is then closed and fixed in place by means of the mounting tabs 49, studs 47 and bolts 48. The rams 32 are then engaged to extend the ram head 34, thereby moving the second stabilizer member 14 toward the first stabilizer member 14. As this occurs, the tires 12 are compressed together between the first and second stabilizing members 14 and onto the tie rods 16 of the first stabilizer member 14. As seen in FIG. 10, when the second stabilizer member 14 is moved toward the first stabilizer member 14, the tie rods 16 of the first stabilizer member engage and go through the holes 15 of the second stabilizer member.

During the compression process, as the tires 12 are pierced by the stabilizer rods 16, the tires 12 are pushed onto the tie rods 16 and held by the rod teeth 13. In this manner the tires 12 are stitched together as show in FIG. 1 and FIG. 2. The intent is to compact and compress many halves of discarded tires 12 between the first and second stabilizer members 14 to form an area of tightly packed discarded tires.

When the desired degree of tire compactness is complete, the first and second stabilizer members are held in place by bolts 17 that placed on the ends of the tie rods 16 of the first stabilizer member. This holds and binds the compressed tires 12 together to form a first mat segment. When the first mat segment is formed the tie rods 16 of the second stabilizer member will be protruding from the first segment.

To form a second mat segment, the rams 32 are then released, a third stabilizer member 14 is placed against the ram head 34 with its tie rods extending through the ram head holes 35. Additional halves of tires 12 are placed within the assembly the cage 38 closed and the ram head 34 along with the third stabilizer member 14 is pushed toward the second stabilizer member to compress the additional discarded tires 12 unto the tie rods 16 of the second stabilizer member. When the desired degree of compactness and density is obtained, the second and third stabilizer members are held together in place by bolts 17 placed on the ends of the tie rods 16 of the second stabilizer member to hold and bind the second mat segment of compressed tires 12 together.

Subsequent mat segments can be achieved in a like manner by using additional stabilizer members 14 and additional halves of discarded tires 12. When a mat of a desired length is completed, there is no need to have the tie rods of a stabilizer member protruding outward to receive additional tires 12. At this stage, a stabilizer cap piece 18 is used in place of a stabilizer member 14. This stabilizer cap piece 18 has holes 15*a* to receive the tie rods of the preceding stabilizer member 14 and will allow the last segment of the pavement mat 10 to be held in place by bolts 17. In this manner the tires 12 between each preceding and succeeding stabilizer member are held tightly in place to form the entire mat 10.

Figure 12:
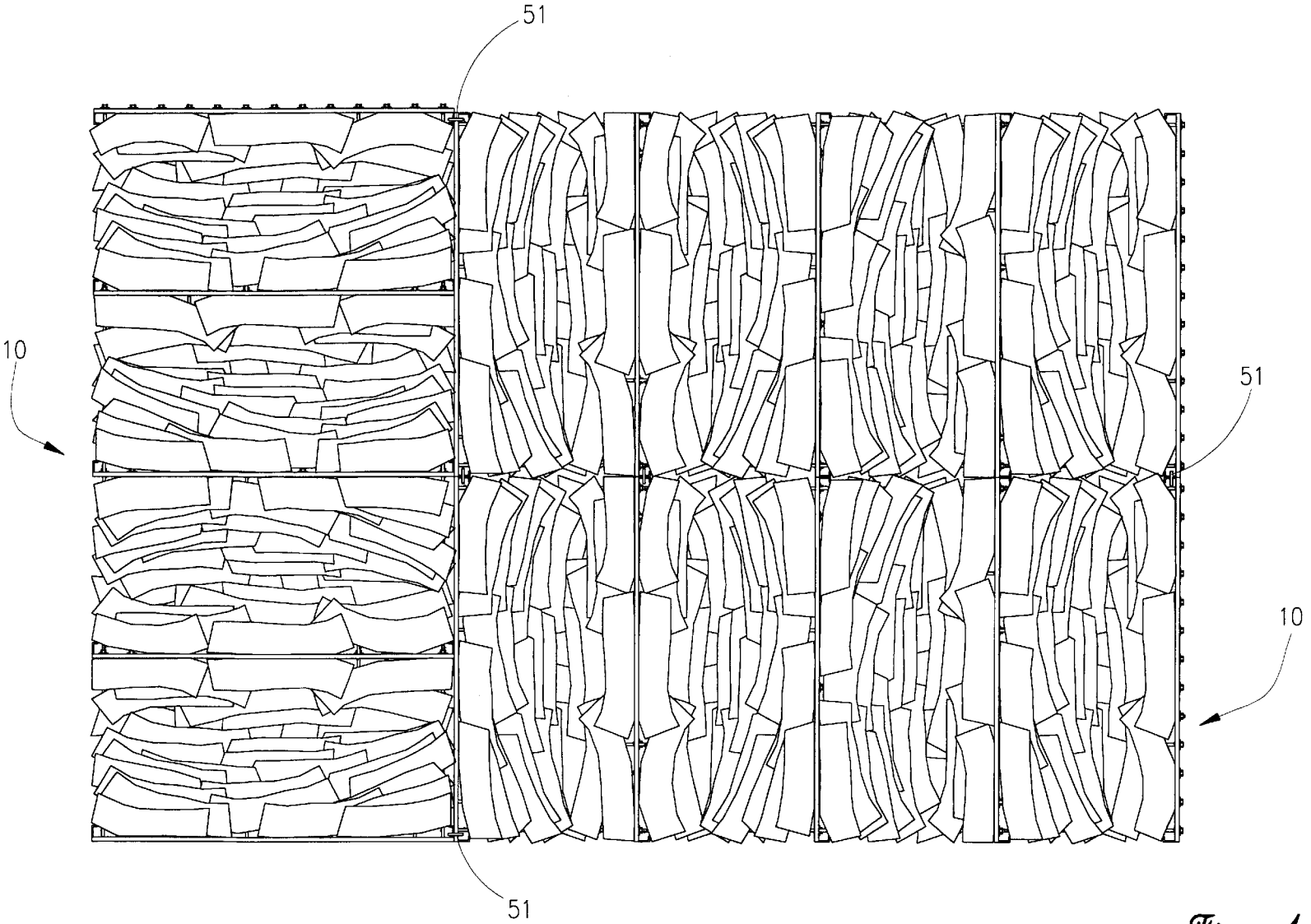
FIG. 12 is a plan view of a pavement area formed from a plurality of pavement mats fabricated in accordance with applicant's invention.

FIG. 12 shows a plan view of a pavement area comprised of a plurality of pavement mats 10 formed in accordance with the method described herein. Each of the pavement mats 10 are held in a fixed relationship with respect to each other by means of a linking pin 51. As shown in FIG. 13, the linking pin 51 is a U-shape metal rod. To link the adjoining mats 10 together, the linking pin 51 is driven over the stabilizing members 14 of the adjoining mats 10. A mall, sledge hammer or other driving means may be used to seat the linking pin 51.

It is thought that many of the intended advantages of the proposed pavement mat and method will be understood from the foregoing description. It is also thought that various changes may be made in form, construction, and arrangement of parts thereof without sacrificing all of the material advantages of the invention or departing from its spirit and scope, the form herein described being merely illustrative of the preferred embodiment of the invention.

I claim:

1. A pavement mat comprising:

(a) a plurality of preceding and succeeding stabilizer members;

(b) a plurality of perpendicularly extending tie rods mounted to each of said preceding and succeeding stabilizer members;

(c) a plurality of vehicle tires positioned between each of said preceding and succeeding stabilizer members, said plurality of tires being penetrated by said tie rods of the preceding stabilizer member and tightly compressed together by the succeeding stabilizer member; and (d) means for tying each of said preceding stabilizer members to its said succeeding stabilizer member so as to tightly bind and compress said tires together.

2. A pavement mat comprising:

(a) a plurality of preceding and succeeding stabilizer members; each of said preceding and succeeding stabilizer members having an end plate to which is mounted a plurality of perpendicularly extending tie rods, each said end plate of each of said stabilizer members having a plurality of rod holes, said rod holes being positioned on each said end plate so as to allow said mounted tie rods of said preceding stabilizer member to be received in said rod holes of said end plate of said next succeeding stabilizer member;

(b) a plurality of vehicle tires positioned between each of said preceding and succeeding stabilizer members, said plurality of tires being penetrated by said tie rods of the preceding stabilizer member and tightly compressed together by the succeeding stabilizer member; and (c) means for tying each of said preceding stabilizer members to its said succeeding stabilizer member so as to tightly bind and compress said tires together.

3. The pavement mat as recited in claim 2, wherein means for tying each of said preceding stabilizer members to its said succeeding stabilizer member includes threading a nut on the ends of said tie rods to hold said preceding and succeeding stabilizer members together.

4. The pavement mat as recited in claim 3, wherein said plurality of vehicle tires are cut into halves across their diameters to facilitate the tight binding and compression of said tires together between said preceding and succeeding stabilizer members.

5. The pavement mat as recited in claim 4, wherein said tie rods are mounted in a top row and a bottom row along said end plates of each of said preceding and succeeding stabilizer members, said tie rods in each said top row being staggered with respect to said tie rods in each said bottom row.

6. The pavement mat as recited in claim 5, wherein a cap plate having no tie rods is used as a said succeeding stabilizer member, said cap plate having a plurality of holes for receiving said tie rods of its preceding stabilizer member.

7. The pavement mat as recited in claim 6, wherein each of said tie rods has a plurality of teeth extending outward from the surface of said tie rod.

8. A pavement mat comprising:

(a) a plurality of preceding and succeeding stabilizer members, each of said stabilizer members having an end plate and a plurality of tie rods extending perpendicularly outward from the surface of said end plate, each said end plate of each of said stabilizer member having a plurality of rod holes, said rod holes being positioned on each said end plate so as to allow said tie rods of said preceding stabilizer member to be received in said rod holes of said end plate of said next succeeding stabilizer member, each of said tie rods having a threaded end section and a plurality of teeth extending outward from its surface;

(b) a plurality of circular vehicle tires, said plurality of tires being penetrated by said tie rods of the preceding stabilizer member and tightly compressed together between each of said preceding and succeeding stabilizer members, each of said vehicle tires being cut into halves across their diameters to facilitate said compression of said tires between said preceding and succeeding stabilizer members; and (c) a plurality of nuts for attachment to said threaded ends of each of said tie rods and thereby tying each of said preceding stabilizer members to its said succeeding stabilizer member so as to tightly bind and compress said tires together between said preceding and succeeding stabilizer members; and (d) a cap plate stabilizer member, without tie rods, for use as the last of said succeeding stabilizer members, said cap plate having holes for receiving each of said tie rods of its immediately preceding stabilizer member.

9. A method for making a pavement mat, said pavement mat having a plurality of discarded vehicle tires tightly compressed between stabilizer plates and bond together by a plurality of tie rods, said method comprising the steps of:

(a) providing a frame, said frame being U-shaped frame with a closed end and an open end, said frame being mounted to a frame base;

(b) providing a frame cover pivotally mounted to said frame;

(c) providing a plurality of said stabilizer members, said stabilizer members being sized to fit within said frame, each of said stabilizer members having an end plate to which is mounted a plurality of tie rods that extend perpendicularly outward from the surface of each said end plate, each end plate of each said stabilizer member having a plurality of rod holes to allow said stabilizer members to be sequentially positioned in said frame with said tie rods of the preceding stabilizer member being received in the rod holes of the succeeding stabilizer member;

(d) providing at least one ram mounted to said frame base at said open end of said frame, said ram having a ram head positioned at the open end of said frame, said ram head having a plurality of holes for receiving said tie rods of a succeeding stabilizer member;

(e) providing means for adjusting the position of said ram, with respect to said open end of said frame;

(f) cutting a plurality of said discarded vehicle tires in half to produce a plurality of discarded tire halves;

(g) placing a first one of said stabilizer members into said frame against said closed end of said frame, said tie rods of said stabilizer member being positioned toward said open end of said frame;

(h) placing a second one of said stabilizer members adjacent to said ram head with said tie rods of said stabilizer member ending through said holes of said ram head;

(i) placing a desired quantity of said discarded tire halves into said frame between said first and said second stabilizer members;

(j) then, closing said frame cover over said tire halves;

(k) engaging said ram to push said ram head, and thereby said second one of said stabilizer members, toward said first stabilizing member whereby said quantity of discarded fires are tightly compressed together and penetrated by said tie rods of said first stabilizer member;

(l) tying said tie rods of said first stabilizer member to said second stabilizer member so as to bind said first and second stabilizer members together with said tires tight compress in between onto said tie rods of said first stabilizer member;

(m) releasing said ram head and opening said frame cover;

(n) placing a third one of said stabilizer members adjacent to said ram head with said tie rods of said stabilizer member ending through said holes of said ram head;

(o) placing a second desired quantity of said discarded tire halves into said frame between said second and said third stabilizer members;

(p) then, closing said frame cover over said tire halves;

(q) engaging said ram to push said ram head, and thereby said third one of said stabilizer members, toward said second stabilizing member whereby said second quantity of discarded tires are tightly compressed together and penetrated by said tie rods of said first stabilizer member; and (r) repeating steps (n) through (q) with succeeding stabilizer members and desired quantities of tires to form a mat of a desired length.

10. The method as described in claim 9 wherein the last of said succeeding stabilizer members is a cap plate without tie rods, said cap plate having holes for receiving the tie rods of its preceding stabilizer member.

* * * * *